US011587439B2

(12) United States Patent
Cross

(10) Patent No.: US 11,587,439 B2
(45) Date of Patent: Feb. 21, 2023

(54) SYSTEMS AND METHODS TO TEMPORARILY ALTER TRAFFIC FLOW

(71) Applicant: STC, Inc., McLeansboro, IL (US)

(72) Inventor: Brad Cross, McLeansboro, IL (US)

(73) Assignee: STC, Inc., McLeansboro, IL (US)

( * ) Notice: Subject to any disclaimer, the term of this patent is extended or adjusted under 35 U.S.C. 154(b) by 61 days.

(21) Appl. No.: 16/715,070

(22) Filed: Dec. 16, 2019

(65) Prior Publication Data

US 2020/0193818 A1 Jun. 18, 2020

Related U.S. Application Data

(60) Provisional application No. 62/779,935, filed on Dec. 14, 2018.

(51) Int. Cl.
*G08G 1/081* (2006.01)
*G08G 1/087* (2006.01)
*G08G 1/095* (2006.01)

(52) U.S. Cl.
CPC ..... *G08G 1/081* (2013.01); *G08G 1/087* (2013.01); *G08G 1/095* (2013.01)

(58) Field of Classification Search
CPC ..... G08G 1/081; G08G 1/087; G08G 1/095
USPC ..... 340/909
See application file for complete search history.

(56) References Cited

U.S. PATENT DOCUMENTS 4,321,589 A 3/1982 King
5,539,398 A 7/1996 Hall et al.
5,610,599 A 3/1997 Nomura et al.
5,929,787 A 7/1999 Mee et al.
6,064,319 A 5/2000 Matta
7,098,806 B2 * 8/2006 Bachelder ..... G08G 1/087 340/916
2001/0037174 A1 11/2001 Dickerson
2009/0256721 A1 10/2009 Glatfelter
2010/0309023 A1 12/2010 Bush
2010/0325720 A1 12/2010 Etchegoyen
2011/0109478 A1 5/2011 Williamson et al.
(Continued)

FOREIGN PATENT DOCUMENTS

KR 1020060107262 A 10/2006

OTHER PUBLICATIONS

International Search Report and Written Opinion, International Patent Application No. PCT/US2019/066472, dated Apr. 17, 2020 (12 pages).

*Primary Examiner* — Jack K Wang
(74) *Attorney, Agent, or Firm* — Lewis Rice LLC

(57) ABSTRACT

A method for permitting a target vehicle to safely violate a right-of-way system of rules is described. The method may comprise, amongst other things, providing a roadway system, wherein the movements of vehicles within the roadway system are governed by a right-of-way system of rules; controlling a traffic control system including a plurality of traffic control signals in a manner that causes the plurality of traffic control signals to change in accordance with default control pattern for implementing the right-of-way system of rules; and modifying the default control pattern. By doings so, the method may permit a target vehicle to safely violate the right-of-way system of rules. Similarly, by doing so, the method may prevent a plurality of secondary vehicles from traveling along or through a predicted path of the target vehicle.

16 Claims, 8 Drawing Sheets

(56) References Cited

U.S. PATENT DOCUMENTS

| | | | | |
|---|---|---|---|---|
| 2012/0229303 | A1 | 9/2012 | Loffl et al. | |
| 2012/0326890 | A1* | 12/2012 | Cross | G08G 1/087 340/906 |
| 2015/0243165 | A1* | 8/2015 | Elsheemy | G08G 1/096775 340/906 |
| 2016/0379490 | A1 | 12/2016 | Simanowski et al. | |
| 2017/0116849 | A1 | 4/2017 | Foreman et al. | |
| 2017/0148317 | A1 | 5/2017 | Diba | |
| 2017/0337819 | A1* | 11/2017 | Wei | G08G 1/166 |
| 2018/0096595 | A1 | 4/2018 | Janzen et al. | |
| 2018/0204451 | A1 | 7/2018 | Cross et al. | |
| 2018/0286228 | A1* | 10/2018 | Xu | G08G 1/082 |
| 2019/0225145 | A1* | 7/2019 | Sippl | B60W 30/10 |
| 2020/0312132 | A1* | 10/2020 | Cross | H04W 4/42 |
| 2020/0342760 | A1 | 10/2020 | Vassilovski et al. | |
| 2020/0402397 | A1* | 12/2020 | Yamazaki | G08G 1/09 |

* cited by examiner

SYSTEMS AND METHODS TO TEMPORARILY ALTER TRAFFIC FLOW

CROSS-REFERENCE TO RELATED APPLICATIONS

This application claims the benefit of U.S. Provisional Patent Application No. US 62/779,935 titled SYSTEMS AND METHODS TO TEMPORARILY ALTER TRAFFIC FLOW, filed Dec. 14, 2018, the entire contents of which are hereby incorporated by reference herein.

BACKGROUND

1. Field of the Invention

This disclosure is related to the field of traffic signal and control systems, and more specifically to systems and methods for temporarily altering or suspending normal traffic flow.

2. Description of the Related Art

The need to manage traffic in roadways is self-evident. Streets are more congested than ever and effective use of traffic control systems can reduce commute times, pollution, and accidents, and increase the overall efficiency of a roadway system.

Historically, traffic management was conducted by traffic police, who physically stood in intersections and directed traffic using hand signals or flags. Later, illuminated traffic signals were used to direct and control traffic. Electric traffic signals are now ubiquitous and familiar. These lights are typically disposed at the corners of intersections, and may be connected to systems for detecting the presence of vehicles in regions near the intersections, such as in turn lanes. A traffic control cabinet near the lights usually contains hardware and other components for controlling the electric signals in response to detected vehicle traffic.

These lights may be operated differently based upon the time of day, or the level of congestion. For example, it is common in many environments for traffic signals to alternate the permitted flow of traffic during busy commuting hours, and to switch the lights to "flashing red," during off-hours. In other instances, intersections may be controlled by static traffic signals, such as signs attached to posts. In other instances, intersections may be entirely uncontrolled, and drivers are expected to be alert and manage cross traffic in the intersection.

Regardless of the method of controlling an intersection or directing traffic flow, most traffic control systems are premised on the concept of right-of-way. The concept of right-of-way has to do with resolving conflicts between or among vehicles, pedestrians, and other forms of traffic sharing routes. The idea is that the law establishes a standard or convention governing which traveler has the right to proceed first in the event of a conflict. These laws are then commonly embodied in the traffic signals and a few easy to remember rules for situations when such defaults need to be modified.

For example, in the United States, when two vehicles arrive simultaneously at a four-way stop, the vehicle on the right usually has the right-of-way to proceed first, which is a simple rule. Right-of-way also applies between different types of traffic. For example, at a railroad crossing, trains are generally incapable of stopping in time to prevent a collision at an intersection, and the energy requirements for stopping and restarting a train are high as compared to vehicular traffic. For these reasons, trains almost always have the right-of-way at a railroad crossing.

Traffic control signals play an important role in right-of-way, in that most jurisdictions provide that right-of-way for a controlled intersection as defined by the traffic control signals. Typically, a green or blue illuminated traffic control signal indicates permission to proceed through the intersection or route, whereas red or orange signals indicate absence of right-of-way and the need to stop. The collection of rights-of-way, combined with the overall traffic flow design of a roadway system, results in a default traffic flow governing any given geographic region. Over time, drivers and other travelers become familiar with traffic flow patterns and learn how to navigate the roadway system in the most time-effective manner.

There are times when it is desirable to alter default traffic rights-of-way. For example, emergency vehicles are often granted a right-of-way above all other vehicles regardless of the display of any signals. A simple example of this is when an emergency vehicle is approaching an intersection. Typical traffic laws indicate that an emergency vehicle, when operating under lights and siren, is to be allowed to proceed into the intersection even when the light for the direction it is approaching indicates traffic in that direction should stop. Thus, drivers are taught that when they are at an intersection, if they hear a sirened vehicle approaching, they should not enter the intersection, even if the light is indicative that they currently have the right-of-way and are allowed to do so. Similarly, drivers are taught (in the United States) to move right if an emergency vehicle is seen behind or in front of them as this allows the vehicle clear access to the middle of the roadway and clear passage.

These types of laws are generally designed for certain circumstances and relatively simple to remember. However, the problem with these types of laws is that they require a clear modification of default right-of-way and it is possible that drivers may not consistently or correctly apply these special rules, instead following the established default. For example, collisions can occur because a driver did not hear the siren of an emergency vehicle approaching on a cross street and entered an intersection based upon a green light indicating that the driver has the right-of-way, when the emergency vehicle was expecting the intersection to be clear and was approaching at high speed. Further, as traffic signals become more complex, often utilizing right and left turn arrows and controls for individual lanes, these "simple" rules altering the default can become difficult for drivers to consistently and correctly apply ad hoc. A simple example occurs from a vehicle which correctly yields to the right for a passing emergency vehicle, but is now prevented by other traffic from moving back to the left to get into a turn lane they need to be in. The rules for clearing traffic when an emergency vehicle approaches are clear, if sometimes difficult to apply, but the rules for restoring the ordinary flow of traffic in the wake of a passing emergency vehicle are less clear, and uncertainty among drivers attempting to reestablish normal traffic flow can itself increase the risk of collisions.

Because of this problem, the use of "priority" systems has become relatively common. In these systems, it is desirable to switch the traffic control lights to allow the emergency vehicle to proceed, and to prevent other traffic from entering into the intersection by detecting the approach of the vehicle and adapting the lights accordingly. For example, if an emergency vehicle is approaching from the west, the lights for vehicles approaching from the north and south provide stop indications until the emergency vehicle clears the intersection. This allows emergency vehicles to reach their destinations more quickly, and reduces accidents caused by vehicles straying into a controlled intersection at the same time as an emergency vehicle as drivers approaching from the north and south have both the siren indicating not to go into the intersection and the red light. The siren thus reinforces the default rule of the red light, indicating that they should not proceed anyway. In effect, the existing right-of-way system embodied by the signal lights is now used to eliminate the need to know the exception for an emergency vehicle.

A problem with these systems is that they merely provide traffic flow "pauses" while an emergency vehicle (or other exception to normal traffic flow) passes, and only deal with the issue at one intersection. From the example above, to allow the vehicle into the intersection, it is easy to say that the north and south approach should be indicated as red, but what about the approach from the east? An eastbound left green arrow could cause drivers to enter the intersection on a potential collision course with the path of the westbound emergency vehicle. Thus, the eastbound light should also be indicated as a "stop" to prevent this.

However, an additional question lies with how to manage the westbound light applicable to the emergency vehicle. This light can also be changed to red, providing stop in all directions, but this will generally require the emergency vehicle to leave the west bound lanes to get through the intersection because other westbound vehicles in front of the emergency vehicle are likely to stop at the westbound light. These stopped vehicles may not be able to easily get out of the way because in congested, traffic-dense areas, there is little space for them to move. Further, in roadways with a center median barrier, the emergency vehicle may not be able to enter oncoming traffic lanes, and thus an emergency vehicle may become stuck behind traffic because of the priority system altering the default right-of-way.

Because of this, the westbound light may alternatively be left green, allowing traffic to clear ahead of the emergency vehicle by having unimpeded access to the intersection. However, if the emergency vehicle is traveling at a higher rate of speed compared to the rest of the traffic, this can present a dangerous situation, because the drivers in front of the emergency vehicle may be alert to the vehicle's approach and not know whether to proceed into the intersection (the default situation provided by the signal) or stop and get out of the way (the generally understood exception when an emergency vehicle is approaching), which can also present a dangerous situation. For example, a westbound driver who wants to turn left and is in the left-most turn lane may not know whether to proceed into the intersection to complete the turn (clearing the turn lane to allow for the emergency vehicle to use to the turn lane to pass the other traffic at the intersection), stay put (allowing the emergency vehicle to pass them on the left in oncoming traffic lanes), or try to move out of the way (potentially crossing other lanes of traffic occupied by equally uncertain motorists). This presents a high stress situation for the driver and a concern for the emergency vehicle driver, who does not know how other drivers will respond, yet must proceed toward the intersection at high speed to reach the emergency quickly.

Further, while the above circumstances produce confusion, they at least all relate to an emergency vehicle where, at least the intended, modifications to signal based right-of-way are generally known to drivers. However, there also are a number of other traffic circumstances where there is no generally accepted modification or exception to traffic flow, or drivers have no idea that a modification to the default rules is desirable. Such circumstances may occur infrequently enough that drivers usually do not know how to respond when they do happen. For example, a driver in a cross street will often not know how many vehicles are actually in a funeral procession (which may have the right-of-way through an intersection even against a light) to know when it is safe to proceed or even that the cross-traffic is a funeral procession with the right-of-way regardless of the state of the signal lights.

In effect, these types of situations present confusion because priority systems attempt to use a default right-of-way signaling system to implement a change to right-of-way, but only in a limited "bubble" surrounding a monitored vehicle. To put it another way, the problems arise because the right-of-way rules in a priority modification are only temporarily paused, and are only paused generally at a single intersection towards which a specific monitored vehicle is approaching. The emergency vehicle (or funeral procession, e.g.,) have priority, but that priority travels with the vehicle and only effects other vehicles in close proximity.

The problems, thus, effectively exist because other vehicles are moving into and out of the area in which the priority vehicle has priority. The confusion generally occurs because other vehicles transition from a situation where the default right-of-way rules of the signal apply to a situation where the priority rules apply, but do so with a possible (but not known) modification to implement the priority rules on the signals. To simplify, drivers other than the priority vehicle do not know if the signals should be followed or not when a priority vehicle is in the proximity as it is unclear what rules the signal is actually implementing. As other drivers need to now interact with the priority vehicle, this creates confusion.

To deal with this circumstance, it would be helpful to simply remove all other traffic from the intersection. If there were no other vehicles in the path of the priority vehicle, that vehicle could simply have priority (going through signals in whatever state they were) without concern. Removing other traffic from an area, however, has traditionally caused major disruptions to traffic flow and can only be provided through specific interventions.

When there are circumstances in which the default traffic flow should be not only paused, but suspended, in order to temporarily allow the movement of a vehicle or set of vehicles contrary to the ordinary flow of traffic, these are commonly implemented via specific human interventions and temporary signals. For example, when a wreck occurs on the interstate resulting in a particular lane(s) being blocked for emergency activity, trucks with mobile arrow signs are commonly positioned, along with police cruisers and flares, to temporarily indicate that lanes are blocked and they physically block access to the lanes. Similarly, traffic officers may stand in intersections and direct traffic with hand signals after a major concert or sporting event to more effectively manage traffic flow irrespective of the electrical signals. However, this type of solution doesn't work for unscheduled events, such as emergencies, and is not resource-efficient for infrequent, small scale traffic disruptions like a funeral procession.

An extreme example of this occurs in road construction or for motorcades where security is required. In these scenarios, barriers such as cones, flares, barricades, arrow trucks, temporary roadways and the like may be positioned to completely alter flow of traffic through an area. For example, traffic may be diverted to go both directions on a single side of a bridge with the diverted traffic quite literally travelling in the wrong direction on the bridge, but being instructed to do so by temporary structures. Alternatively, intersections or highway entrances may be completely blocked or closed to traffic to allow passage of a dignitary's motorcade.

While the above is an effective methodology to radically alter traffic flow and provide for an area of roadway with no traffic on it, it is slow to implement and incredibly resource intensive. To stop traffic entering a highway, for example, typically requires a large amount of infrastructure to be provided through the use of police cruisers and the like to make sure that the default traffic flow is interrupted correctly and in a way it is understood making it something that requires large amounts of preparation. Further, traffic needs to be routed in some other direction while the suspension occurs. This type of infrastructure installation cannot be done, for example, if an emergency vehicle needs to travel in the wrong direction for one block on a one-way road simply because it will be a little faster for it to get to a patient in need or for a lower level dignitary where security may not be as extreme a concern.

Further, in many instances, the electrical signals required to implement such a system simply do not exist because it is not cost-effective to add an electric traffic control to roads to deal with this infrequent circumstance. Such signal lights would rarely be used, and the overhead of installing and maintaining them is unlikely to justify the marginal gain realized from such infrequent use. Thus, a traffic control system is typically not configured to, or even capable of, temporarily suspending the ordinary traffic flow plan in order to allow temporary passage of a vehicle or set of vehicles in a situation where the path of the vehicle is cleared.

SUMMARY OF THE INVENTION

The following is a summary of the invention, which should provide to the reader a basic understanding of some aspects of the invention. This summary is not intended to identify critical elements of the invention or, in any way, to delineate the scope of the invention. The sole purpose of this summary is to present in simplified text some aspects of the invention as a prelude to the more detailed description presented below.

Because of these and other problems in the art, described herein, among other things, are systems and methods for temporarily altering the default or conventional traffic flow in a roadway system. In effect, the systems and methods "tunnel" a temporary, alternative traffic flow through an existing default traffic flow or right-of-way. The systems and methods described herein can be implemented using existing structures and methods for detecting the presence, or approach, of vehicles at an intersection. These prior art systems and methods include, but are not necessarily limited to, the use of in-pavement detection systems connected to a traffic cabinet, vehicle control units installed in certain types of vehicles, and other detectors and control methods which will be familiar to a person of ordinary skill in the art, and need not be further described herein.

Described herein, among other things, is a method for permitting a target vehicle to safely violate a right-of-way system of rules. The method may comprise: providing a roadway system, wherein the movements of vehicles within the roadway system are governed by a right-of-way system of rules; controlling a traffic control system including a plurality of traffic control signals in a manner that causes the plurality of traffic control signals to change in accordance with default control pattern for implementing the right-of-way system of rules; operating at least one target vehicle including a vehicle control unit within the roadway system; monitoring at least one aspect related to the target vehicle's movement within the roadway system using the vehicle control unit; modifying the default control pattern based on the at least one aspect monitored by the vehicle control unit; and permitting the target vehicle to safely violate the right-of-way system of rules by modifying at least a part of the default control pattern.

In an embodiment of the method, the target vehicle is an ambulance.

In an embodiment of the method, the target vehicle is a bus.

In an embodiment of the method, the at least one aspect monitored by the vehicle control unit is a position of the target vehicle.

In an embodiment of the method, modifying the default control pattern results in the target vehicle avoiding other vehicles within the roadway system.

In an embodiment of the method, the method further comprises removing the modification to the default control pattern after the target vehicle reaches a predetermined position.

In an embodiment of the method, the target vehicle has a predetermined route between a starting point and an ending point, and wherein the predetermined position is the ending point.

In an embodiment of the method, the target vehicle has a predetermined route between a starting point and an ending point, and wherein the predetermined position is a position between the starting point and the ending point.

In an embodiment of the method, the default control pattern includes at least one traffic control signal for a one-way street, which one-way street has a default direction of traffic, and wherein safely violating the right-of-way system of rules include permitting the target vehicle to travel against the default direction of traffic on the one-way street.

In an embodiment of the method, the method further comprises modifying the default control pattern for the at least one traffic control signal for a one-way street to allow the target vehicle to safely violate the right-of-way system of rules.

Also described herein, among other things, is a method A method for providing a clear path for a target vehicle operating within a roadway system, the method comprising: providing a roadway system, wherein the movements of vehicles within the roadway system are governed by a right-of-way system of rules; providing a target vehicle within the roadway system; providing a plurality of secondary vehicles within the roadway system; controlling a traffic control system including a plurality of traffic control signals in a manner that causes the plurality of traffic control signals to change in accordance with default control pattern for implementing a right-of-way system of rules; operating at least one target vehicle including a vehicle control unit within the roadway system; monitoring at least one aspect related to the target vehicle's movement within the roadway system using the vehicle control unit; generating a predicted path for the at least one target vehicle based at least in part upon the at least one aspect monitored by the vehicle control unit; and modifying the default control pattern to prevent the plurality of secondary vehicles from traveling along or through the predicted path.

In an embodiment of the method, the target vehicle is an ambulance.

In an embodiment of the method, the target vehicle is a bus.

In an embodiment of the method, the at least one aspect monitored by the vehicle control unit is a position of the target vehicle.

In an embodiment of the method, modifying the default control pattern results in the target vehicle avoiding other vehicles within the roadway system.

In an embodiment of the method, the method further comprises removing the modification to the default control pattern after the target vehicle reaches a predetermined position.

In an embodiment of the method, the target vehicle has a predetermined route between a starting point and an ending point, and wherein the predetermined position is the ending point.

In an embodiment of the method, the target vehicle has a predetermined route between a starting point and an ending point, and wherein the predetermined position is a position between the starting point and the ending point.

In an embodiment of the method, the default control pattern includes at least one traffic control signal for a one-way street, which one-way street has a default direction of traffic, and further comprising permitting the target vehicle to travel against the default direction of traffic on the one-way street.

In an embodiment of the method, the method further comprises modifying the default control pattern for the at least one traffic control signal for a one-way street to allow the target vehicle to safely violate the right-of-way system of rules.

DETAILED DESCRIPTION OF THE PREFERRED EMBODIMENT(S)

This following detailed description and disclosure are intended to teach by way of example and not by way of limitation. As a preliminary matter, it should be noted that, while the description of various embodiments of the disclosed system will discuss the movement of various special-purpose vehicles (such as, but not limited to, emergency vehicles, maintenance vehicles, and mass transit vehicles, buses, light rail trains, and street cars) through signal lights, this in no way limits the application of the disclosed traffic control system to such uses. Any vehicle which could benefit from the traffic control systems and methods described herein is contemplated.

Figure 1:
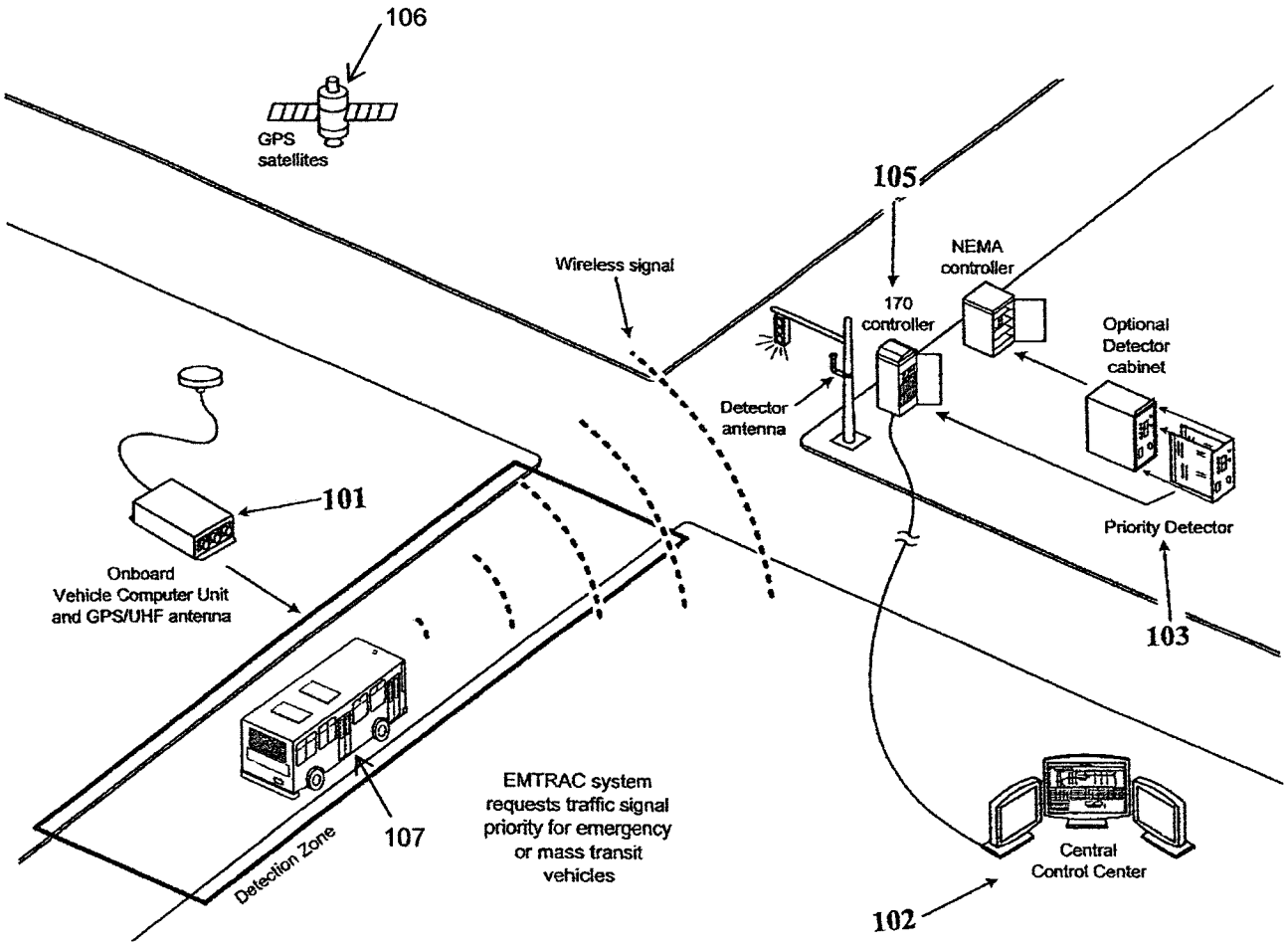
FIG. 1 provides a diagram of a prior art embodiment of a geographic detection method.
Figure 2:
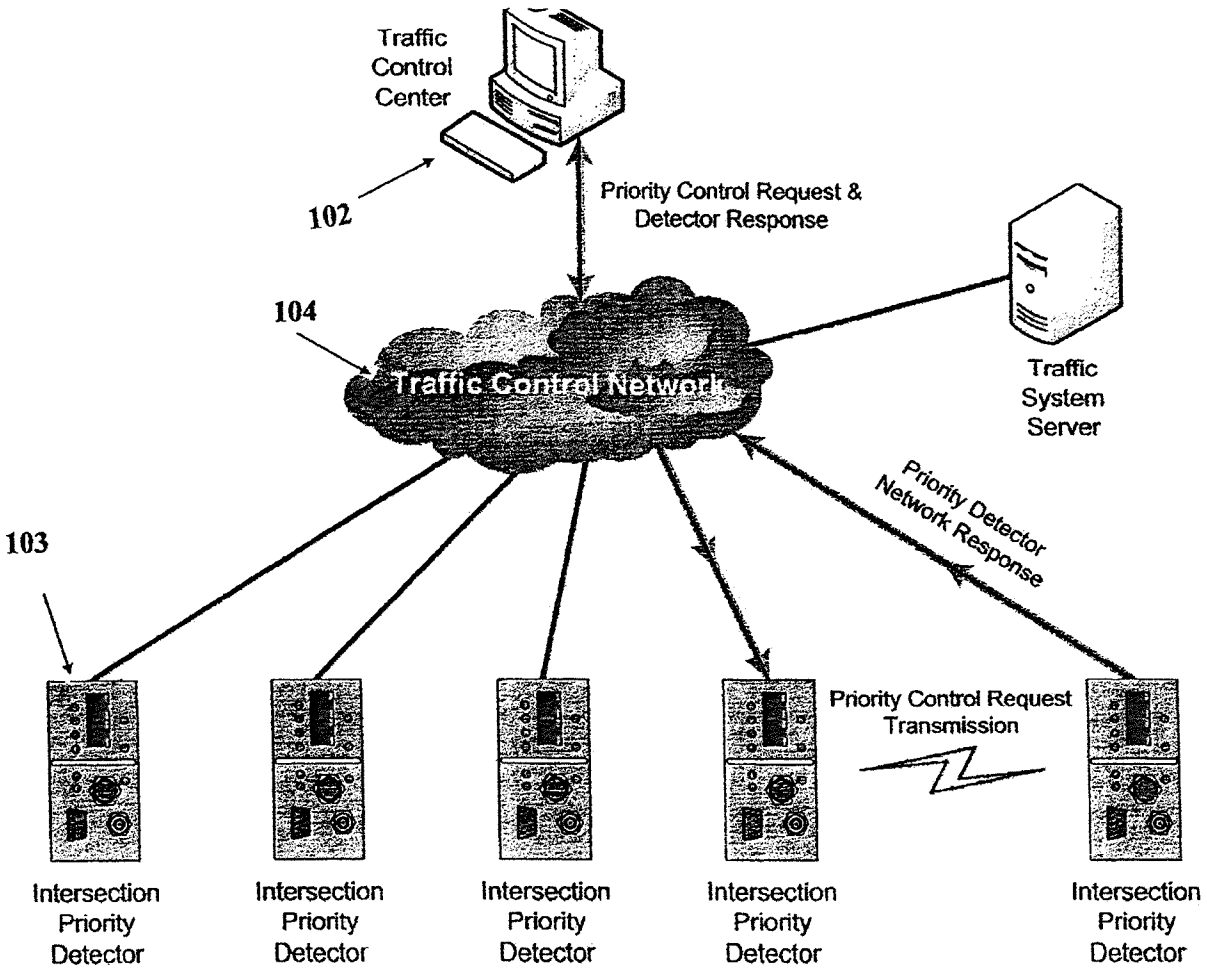
FIG. 2 provides a diagram of how traffic components interface through a traffic control network of a prior art priority system.
Figure 3:
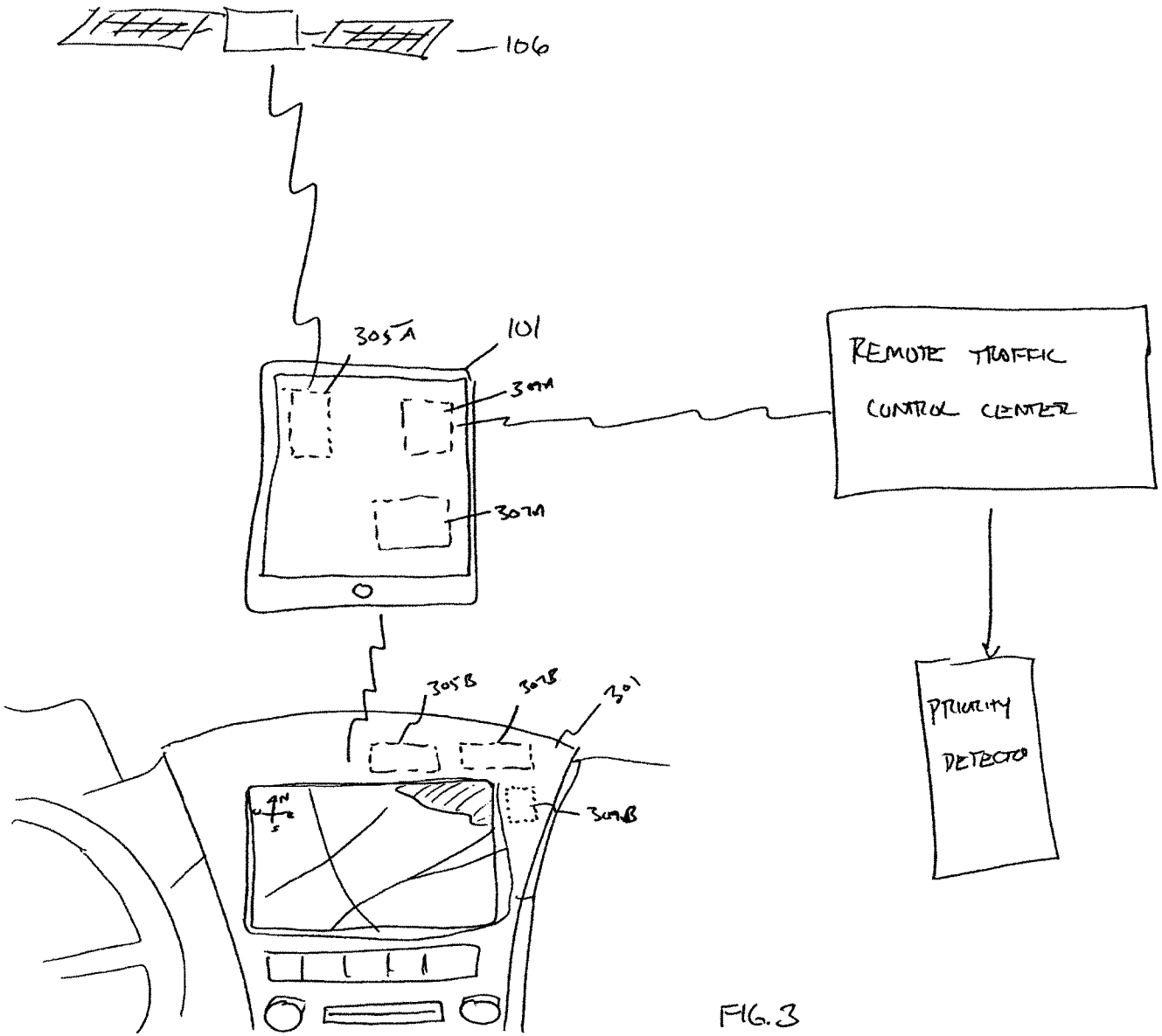
FIG. 3 depicts an embodiment of a traffic priority system using a mobile smart device.
Figure 4:
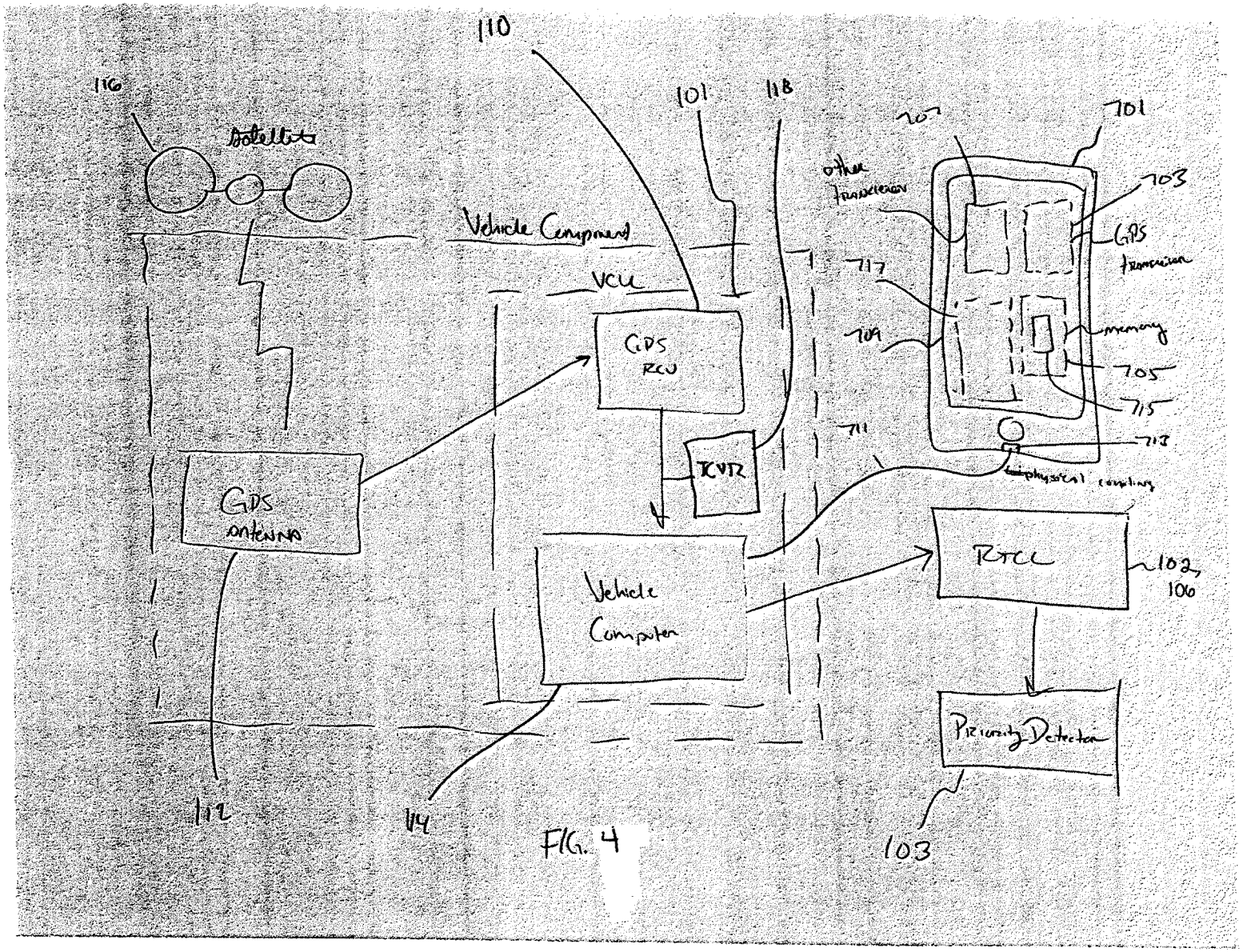
FIG. 4 depicts a block diagram of a traffic control system using a mobile smart device.

The traffic control system described herein is an improvement upon systems described in U.S. Pat. Nos. 8,878,695, 8,773,282, 9,330,566 and 9,916,759. The entire disclosure of all of these documents is incorporated herein by reference. An embodiment is shown in FIGS. 1-3. In the depicted embodiment, the hardware components include a vehicle equipment unit/vehicle computer unit (VCU) (101) installed associated with one or more monitored vehicles, and a priority detector (103) installed in or near signal control cabinets (along with a cabinet- or pole-mounted antenna). The main hardware components of the system, such as the VCU (101) and the priority detector (103) generally communicate wirelessly using secure frequency hopping spread spectrum radio. The mobile-vehicle mounted hardware components, such as the VCU (101), utilize a positioning system (106) to continually determine the real-time location of the VCU (101), and, by extension, a monitored vehicle with which it is associated. The VCU (101) may communicate in a traffic control network.

As shown in FIG. 1, the VCU (101) is associated with monitored vehicles (107) in a roadway system. As noted previously, contemplated monitored vehicles (107) include, but are not necessarily limited to, mass transit vehicles (buses, trains, light rail, etc.), emergency vehicles (fire trucks, police cars, ambulances, etc.), waste management vehicles, and road maintenance vehicles. It should be understood that the system disclosed herein contemplates the installation of one or more VCUs (101) in various vehicles traveling and operating in the roadway system.

The functions and methods of such a network and the associated devices are described in more detail in U.S. Pat. Nos. 8,878,695, 8,773,282, 9,330,566 and 9,916,759. For example, various methods of estimating time of arrival may be implemented. Also, features such as conditional transit signal priority, automatic vehicle location, and vehicle activity monitoring may be implemented.

In an embodiment, such systems and methods may be supplemented, augmented and/or substituted, in whole or part, by a user device or a mobile user device as described in U.S. patent application Ser. No. 16/597,538, filed Oct. 9, 2019, the entire disclosure of which is incorporated herein by reference. In particular, such as depicted in FIG. 3, the system may be supplemented, augmented and/or substituted in whole or part, by a user device or a mobile user device.

These and other similar systems are used to implement the zone control systems and methods described herein. The present disclosure uses these and other systems and methods for traffic control to temporarily suspend a default set of traffic rules or rights-of-way in order to facilitate the safe passage of one or more vehicles which have a temporary need to move in a manner not otherwise permitted or contemplated in the design of the roadway system by facilitating the clearance of the vehicle's path of the presence of other vehicles.

A modern roadway system is typically designed to facilitate an efficient flow of traffic through a geographic region. This is done through a combination of default rules governing the resolution of priority conflicts among multiple vehicles, where multiple travelers simultaneously desire to use a roadway in a manner that is mutually exclusive. These default rules include right-of-way conventions, often defined by law or regulation, governing priority access to uncontrolled intersections, in combination with static and dynamic control of rights-of-way using signals.

For example, where a route is lengthy and has a number of controlled intersections, the signal lights are typically timed so that vehicles will pass through multiple green lights in a row before encountering a red light, preventing start-and-stop traffic from building up and frustrating drivers. Similarly, signal light duration and intersection design is typically engineered to quickly route traffic out of congested areas to faster multilane roadways, such as highways. The collection of default rules, static signage, and dynamic signals, constitutes the default, standard, or normal set of rules, or rights-of-way, governing the flow of traffic in a roadway system within a geographic region.

This design typically does not contemplate or allow for the temporary suspension or contradiction of these rules without direct human intervention. For example, a one-way street has a set of One-Way and Do Not Enter signs disposed at various entrance points to alert drivers of the permitted flow of traffic. If there is a need to allow a vehicle to travel the wrong way on such a street, traffic should be prevented from entering from the normally permitted direction. However, there is no way to reverse the signage. Thus, if there is need for a vehicle(s) to travel in the wrong direction on a one-way street, the signage does not provide sufficient notice or ability to prevent traffic from entering and it is necessary to put a patrol car and/or police officer to block the entrance to close the road.

The systems and methods described herein may overcome the shortcomings by establishing one or more logical traffic zones, detecting the presence of one or more vehicles (e.g. using VCU) in relation to the one or more of the logical traffic zones, and using automated computer software systems to operate one or more electric traffic control devices based upon that detection, to temporarily suspend or alter overall traffic flow in furtherance of a traffic management goal or purpose associated with the monitored vehicle(s) (e.g., a "tunneled" traffic flow). Generally, that goal will be implemented by clearing or attempting to clear a path for the monitored vehicle through traffic by keeping other traffic away from the path of the monitored vehicle. As described further in the examples below, these systems and methods have the effect of temporarily suspending or changing the normal rights-of-way in order to allow the passage of a vehicle, by altering the traffic signals surrounding an area to inhibit vehicles from entering the pathway of the vehicle, and to remove vehicles that are already in the pathway.

Figure 5:
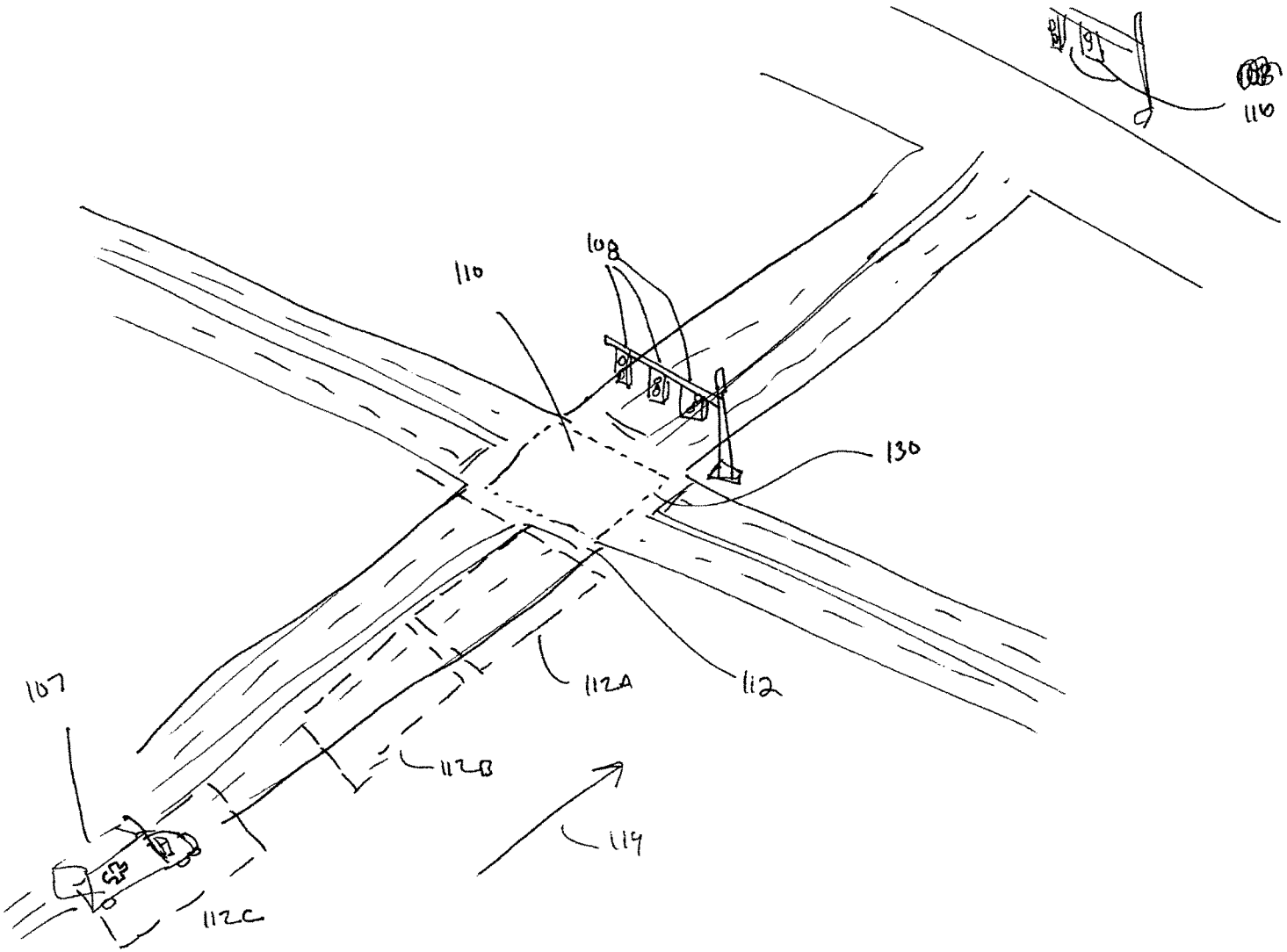
FIG. 5 depicts an embodiment of a traffic control system as described herein.

This is illustrated in the exemplary embodiment of FIG. 5. FIG. 5 depicts a traffic intersection (110) controlled by one of more traffic signals (108). The depicted intersection is a four-way stop created by two intersecting roads for automotive traffic, but the systems and methods described herein are suitable for use in any type of traffic intersection, including, but not necessarily limited to, three-way or five-or-more way stops, traffic circles, roundabouts, on and off ramps, and so forth. Additionally, the systems and methods described herein are suitable for use in signal-controlled intersections for non-automotive traffic, such as, but not necessarily limited to, rail traffic (e.g., track switches), vessels (e.g., controlling ingress and egress with respect to a lock or narrow channel), small personal vehicle traffic (e.g., commuter scooters), and non-motorized traffic, such as but not necessarily limited to, bicycles and pedestrians (e.g., walk/don't walk signals). Although a conventional electric traffic control signal is depicted in the drawings, a person of ordinary skill in the art will understand that the systems and methods described herein are applicable to any form of traffic signal, including illuminated signals, semaphore signals, auditory signals, and so forth.

In the depicted embodiment of FIG. 5, one or more traffic control zones (112A), (112B), and (112C) are established. The depicted traffic control zones are logical geographic boundaries disposed over a portion of a thoroughfare prior to the traffic signal (108) with respect to the ordinary or lawful flow of traffic. In the depicted embodiment, the thoroughfare (112) is a vehicular roadway, and the traffic flow (114) is from the bottom left of the figure to the upper right, in the right-hand lanes (e.g., right-handed traffic flow, as in the United States). The depicted one or more traffic control zones (112A), (112B), and (112C) are thus disposed overlapping various portions of the roadway (112) prior to the traffic signal (108) in the direction of traffic flow (114), meaning vehicles approaching the traffic signal (108) will, in the vast majority of cases, sequentially pass through, in order, each of zones (112C), (112B), and then (112A) before reaching the traffic signal (108).

A traffic control zone (112A), (112B), and (112C) is a logical border defined geographically. This may be done using physical markers which provide boundary indicators via local transmissions, but in the depicted embodiment, they are virtual boundaries defined via geo-fencing using geographic coordinates according to a mapping system (106). For example, traffic control zones (112A), (112B), and (112C) may be defined by a sequence of GPS coordinates identifying vertices of a polygon, or a set of GPS coordinates identifying vertices of a polyhedron. A zone may be defined by any party, including a public or governmental authority such as a municipality, roads and streets department, or public works department, or by a private organization such as a construction company or traffic management consultant. In an embodiment, zones may be defined by a combination of these. For example, a governmental authority may publish a set or catalogue of traffic control zones for shared utilization to improve efficiency and achieve consistency.

As a monitored vehicle (107), such as using a VCU (101) associated with the vehicle (107) as described elsewhere herein and in the incorporated references, approaches the controlled intersection (110), it passes through a first traffic control zone (112C) of the one or more traffic control zones (112A), (112B), and (112C). This may be detected optionally along with other characteristics of the monitored vehicle (107) or its environment. These may include heading, speed, acceleration, deceleration, or other characteristics which can be determined through use of sensors or data on, near, or associated with the monitored vehicle (107), such as temperature (e.g., via an on-board vehicular telematics system, including a thermometer) or local weather (via a weather data service, such as the National Weather Service).

In the depicted embodiment, the monitored vehicle (107) is shown as an ambulance, but this is for exemplary purposes only and should be understood as non-limiting. As described in this disclosure and in the other disclosures referenced and incorporated herein, any vehicle (including non-emergency vehicles and personal vehicles) can be monitored and serve as a monitored vehicle (107) for purposes of this disclosure. Additionally and/or alternatively, it is possible through the use of multiple detection zones using physical detection systems (e.g., magnetic coils embedded in the thoroughfare, traffic cameras, and other presence detecting technologies) to monitor or track the presence of vehicles in one or more traffic zones without a VCU.

A decision may be made at this point (e.g., via the traffic control center (102)) to operate the traffic control signal (108), and, if so, how to operate the traffic control signal (108), based upon the detection of the monitored vehicle (107) in the first traffic control zone (112C), and possibly based upon one or more of the detected characteristics of the vehicle detected in the first traffic control zone (112C). For example, if the monitored vehicle (107) is detected as underdoing significant deceleration, it may be inferred that the vehicle is braking due to stopped or slowed traffic between the monitored vehicle (107) and the intersection (110). If the traffic control signal (108) is red/stop for that traffic, the decision may be to begin transitioning to a green/proceed signal to make it easier for the intervening traffic to advance and get out of the way of the monitored vehicle (107) so it may pass. The decision may be made by a human operator monitoring a roadway system in real-time, or automatically, using software programmed to receive, analyze, and act upon this data, also in real-time. It should be noted that the decision step may include a decision to alter the state of the traffic control signal, or may be a decision to not alter it. For example, if the traffic control signal (108) is already green/proceed, then the controlled intersection (110) is already in the preferred state to advance the monitored vehicle (107) quickly and safely to its destination. Additionally and/or alternatively, the presence of intervening traffic may be directly detected using vehicular detection systems, such as magnetic coils in the pavement and traffic cameras coupled to image recognition systems.

It should be further noted that the decision made will not necessarily be based solely upon a desire to route the monitored vehicle (107) quickly, or to prioritize it, through this intersection, but, rather, is based on an overarching traffic control goal with respect to the nature and purpose of the monitored vehicle (107) in question. That goal may be, in many instances, to give the monitored vehicle (107) priority over other traffic between two points such as the point of picking up a patient and arriving at a hospital, but this is not true in all instances. For example, in another exemplary instance where the monitored vehicle (107) is a bus (e.g., a municipal bus or a school bus) detected as running ahead of schedule, it may be desirable to de-prioritize the bus to slow it down and prevent it from arriving early at a stop, which could result in riders missing the bus even though they got to the stop on time. This could result in a decision to alter a green/proceed traffic signal (108) to red to put the bus back on schedule. As will be clear to a person of ordinary skill in the art, this "goal" for the vehicle may be represented in a data record associated with the vehicle.

The monitored vehicle (107) may then pass through the first traffic control zone (112C) and proceed towards a second traffic control zone (112B) of the one or more traffic control zones (112A), (112B), and (112C). Again, this may be detected optionally with other characteristics as described elsewhere herein. Again, a decision may be made or revised at this point to operate the traffic control signal (108), and, if so, how to operate the traffic control signal (108), based upon the detection of the monitored vehicle (107) in the second traffic control zone (112B), and possibly based upon one or more of the detected characteristics of the vehicle detected in the second traffic control zone (112C). This decision may also be influenced by the first detection in the first traffic control zone and/or the related characteristics.

For example, if the monitored vehicle (107) is detected as underdoing significant deceleration in the first traffic control zone (112C), the traffic control signal (108) is changed to green/proceed, but the monitored vehicle (107) is moving even more slowly in the second traffic control zone (112B), or has stopped, it may be inferred that traffic ahead of the monitor vehicle (107) is still unable to proceed through this intersection due to congestion ahead. Thus, a second traffic control signal (116) may be operated, such as by transitioning to a green/proceed state in an attempt to clear traffic further ahead, beyond the intersection (110), in an attempt to break up the congestion and assist the monitored vehicle (107) through the intersection (110). This also allows for the monitored vehicle (107) to proceed on its route which is presumed straight through the intersection (110). Other traffic control signals (not shown) may also be operated to prepare each successive intersection in the path of the monitored vehicle (107) for its arrival by keeping other vehicles from being in the path of the monitored vehicle.

It should be recognized that the system is generally designed to keep vehicles off the path of the prioritized vehicle (107) and to remove other vehicles from the path of the monitored vehicle (107). In order to provide this, not only can the signal (108) be operated to allow the monitored vehicle to proceed and cross traffic to be inhibited, but also signals on the two cross streets at the signal (108) (which are off the page) may also be made red in all directions to inhibit a vehicle from actually entering the cross street and being at the signal (108) from either opposing direction. A vehicle coming from the bottom right and turning right at the intersection (110) would be turning into the path of the monitored vehicle which can present an obstacle to the monitored vehicle (107). Further, a red light for them at the signal (108) would not inherently stop them from entering the path, as in the United States, turning right on a red light is a generally accepted practice. To avoid this vehicle entering the path of the monitored vehicle (107), this vehicle can be stopped at an off the page intersection so it does not arrive at the intersection (110) prior to the monitored vehicle (107) passing through the intersection (110). In this way, it will not turn into the path of the monitored vehicle (107) in front of it, but will arrive at the intersection (110) only after the monitored vehicle (107) has cleared the intersection, placing this new vehicle behind (and out of the path) of the monitored vehicle (107).

Similarly, if the monitored vehicle (107) is going to be traveling straight through the intersection (108) and turning left at the following signal (116), the signal (116) can be made green for both directions of turn (and red in all other directions) when the monitored vehicle is in the area (112B). This clears the intersection at the signal (116), but also discourages vehicles that may be going straight through that intersection from getting in front of the monitored vehicle (107) and later getting in its way. To take this to a logical next step, it would be possible to allow vehicles at the signal (116) to actually turn right, but hold them from turning left while stopping traffic in all other directions. This would clear the right lane at signal (116) and allow the monitored vehicle (107) to turn left form the right lane (on red) getting in front of all vehicles wanting to turn left at the signal (116) so that they cannot hold it up later in its path.

As should be apparent from the example of FIG. 5, control of multiple intersections along a monitored vehicle's (107) path can be used to not just give the monitored vehicle (107) priority through an intersection, but to actually clear the monitored vehicle's (107) path to its destination of other vehicles. In effect, vehicles are removed from in front of the monitored vehicle (107) by giving those vehicles a form of priority, which should result in them leaving the path of the monitored vehicle (107), and lowering their priority to inhibit them from entering the path of the monitored vehicle (107). This serves, in the net, to move vehicles out of the path, effectively placing them behind the monitored vehicle (107) instead of in front of it.

Figure 6:
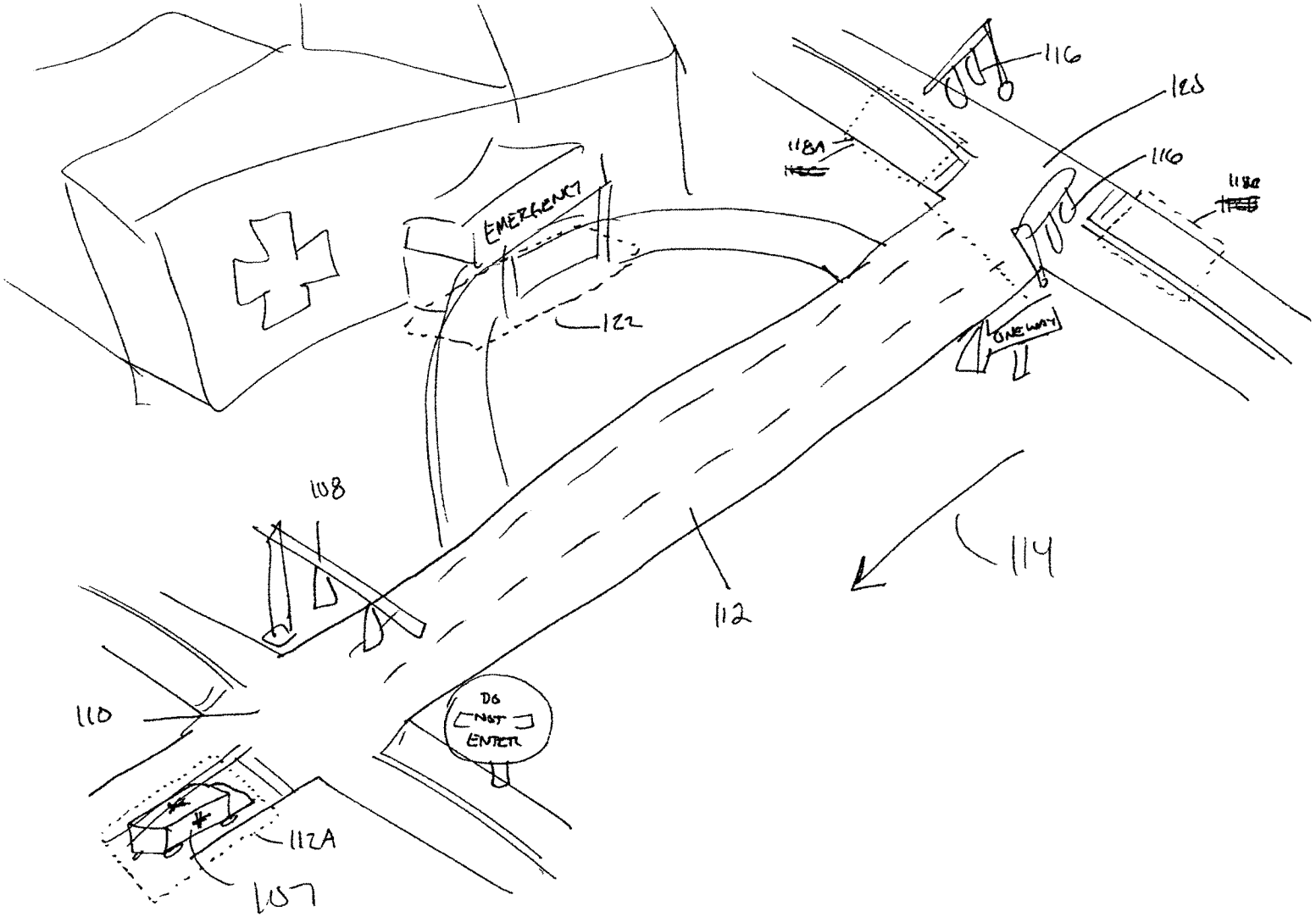
FIG. 6 depicts an alternative embodiment of a traffic control system as described herein.

It should be noted that the systems and methods described herein are applicable to other traffic controls situations as well, and are not limited to intersections. By way of example and not limitation, in the depicted embodiment of FIG. 6, the systems and methods described herein are used to control access to a thoroughfare in order to alter the normal flow of traffic so that a monitored vehicle (107) may safely pass. In the depicted embodiment, the thoroughfare (112) is a one-way roadway in which the traffic flow (114) is unidirectional. The monitored vehicle (107) is again shown as an ambulance, again for illustrative, non-limiting purpose of an example. The ambulance (107) is attempting to reach a medical facility accessible on the one-way road (112), but is approaching from the wrong side due to the one-way traffic flow (114).

Instead of circling around, and potentially losing precious time to treat the patient being transported, in the depicted embodiment, as the ambulance passes through the sequence of traffic control zones (only zone (112A) is shown), the traffic signals (108) and (116) are operated to disallow further traffic on the road (112), while also causing traffic already on the road (112) to pass. For example, the traffic control signal (108) at the tail intersection (110) of the one-way road (112) is maintained in green/proceed state to cause traffic on the road (112) to clear (even though traffic in this direction is oncoming to the monitored vehicle (107)), while the traffic control signals (116) at the head intersection (120) of the one-way road (112) are controlled to maintain at a red/halt state to inhibit further traffic from entering the one-way road (112). Again, to prevent right turns from the head intersection (120) from area (118A), traffic may be halted at a prior intersection to inhibit there being vehicles at the signal (116) in area (118A) and further clear the road (112).

Because the monitored vehicle (107) was detected in a sequence of traffic control zones (112A), (112B), and (112C), there is time for these traffic control decisions to be implemented before the ambulance arrives at the tail intersection (110), clearing the one-way (112), and allowing the ambulance to safely proceed in the wrong direction to reach the medical facility more quickly. Once the ambulance has left the one-way road (112), the lights (108) and (116) can return to normal operation and normal one-way traffic flow (114). The ambulance can be detected as having left the road by use of, for example, another traffic control zone (122) on the hospital campus.

As should be apparent from the above, the system, by not simply altering a signal that the monitored vehicle (107) is approaching, but by altering the traffic flow from other signals as well, allows for a road to effectively be cleared ahead of the monitored vehicle to allow it to proceed effectively down an empty road (even the wrong way) which can be much safer if the vehicle is proceeding at high speed or otherwise presents a traffic hazard.

In an embodiment, the system would effectively be able to empty the road along an entire pathway of a vehicle to allow that vehicle to proceed without any interference from traffic at all. Thus, an ambulance (for example) picking up an emergency patient, could begin a route to the hospital. The system, detecting the location of the ambulance and its path (which may be predetermined such as through mapping software or simply by likely destinations being selected based on its initial heading) can begin to clear the roads utilizing alterations to the various traffic signals all along the path. In this way, by the time the ambulance arrives at a later intersection, there are no cars in the intersection and no cars which could move into the intersection or into the ambulance's path without the driver purposefully violating a signal light. Doing this along the entire path of the ambulance, allows the ambulance to proceed through its route at a constant high speed as the road is effectively "closed" for its passage.

A further benefit of the system is that other vehicles can be relatively unaware of the ambulance's passage while still granting it right-of-way. For example, a vehicle may note that a light two intersections away didn't signal a left turn for one extra cycle (or seemed to stay red a long time) without realizing that doing so placed them behind the ambulance going fast down another street instead of allowing them to get in front of it. This ability to effectively "hide" that the traffic interruption has occurred can be very powerful for allowing passage of something like a motorcade carrying a sensitive passenger. Currently, everyone knows the path of the motorcade and where the streets are blocked which can allow someone to purposefully run barricades if they wish to interfere with it. Thus, such barricades require large amounts of manpower to maintain. In the present system, this can be avoided because the motorcade's passage may not even be detected by drivers. It should be further recognized that the ability to hide the passage to drivers becomes even more extreme in the event that autonomous vehicles are on the road. In this case, the lack of transition of the signal may not even be detected by the passengers.

Figure 7:
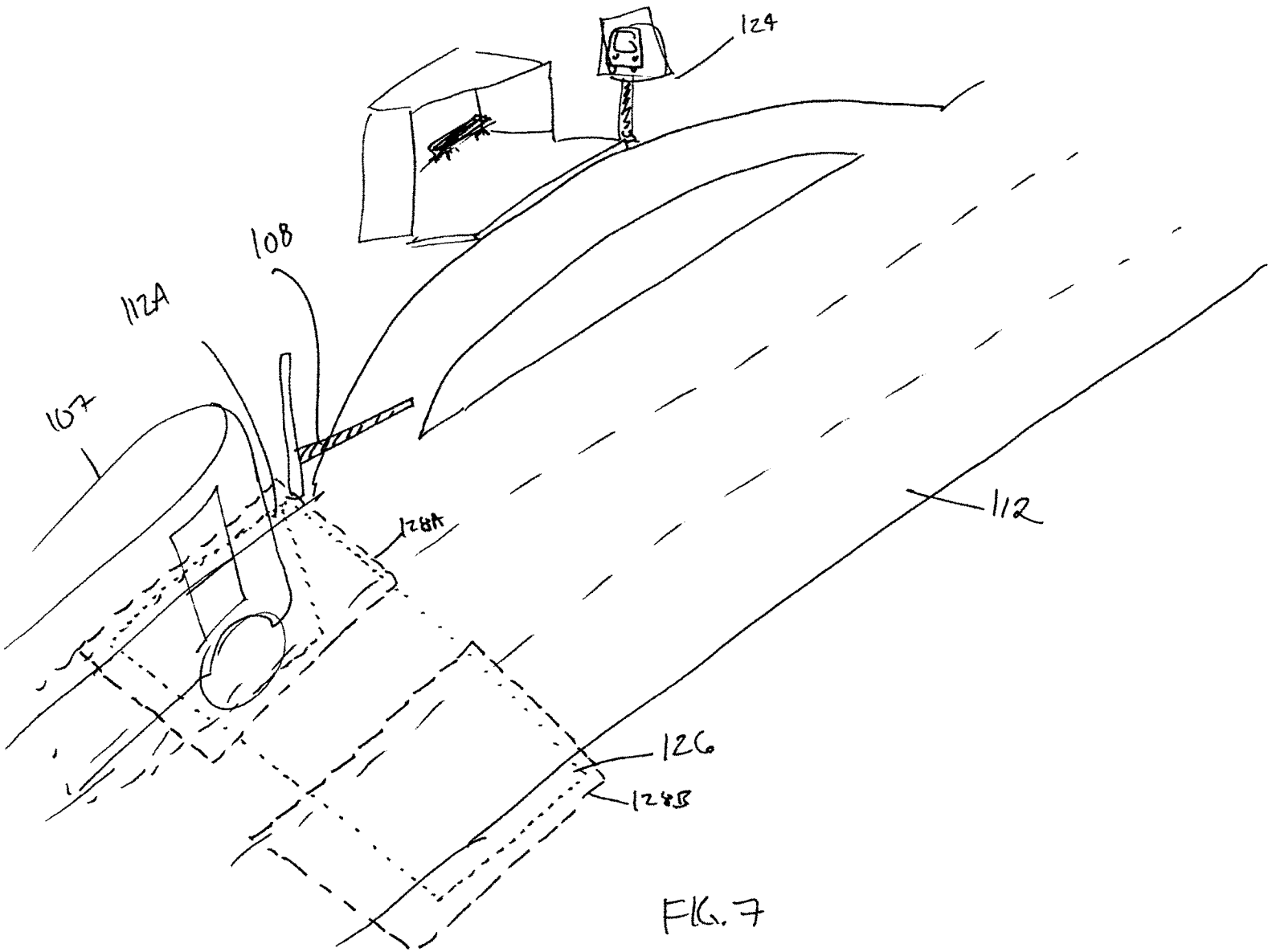
FIG. 7 depicts another alternative embodiment of a traffic control system as described herein.

FIG. 7 depicts another exemplary embodiment using a non-illuminated traffic control signal. In the depicted embodiment of FIG. 7, the monitored vehicle (107) is a municipal bus on a route, approaching a stop (124). The depicted stop is on a siding with a traffic control gate (108) preventing regular traffic from entering the siding. The traffic control zones are a sequence of zones in the left-hand lane leading up to the traffic control gate (108). As the monitored bus (107) is detected in the sequence of zones, its deceleration can be detected, and it can be determined that the bus is on schedule for the stop (124), and the traffic control gate (108) can be raised to allow the bus to pass, and then lowered after the bus enters the siding. This can be accomplished without the need to alter the flow of traffic ahead of the bus in its lane because the bus already appears to be able to slow and reach the siding stop (124). However, if a municipal bus passed this stop in the right-hand lane but was also decelerating, it would not be stopping at the stop (124), but there may be a need to alter the traffic signals in front of the bus in order to keep it on schedule to other stops. As the bus would not pass through the sequence of traffic control zones, and the gate (108) also would not be raised.

Similarly, if a monitored bus (107) was detected in the left-hand lane passing through the zones, but was not detected as decelerating, it may be inferred that the driver does not intend to stop at stop (124), and the gate is not raised. If this bus was scheduled to stop at stop (124) it may be determined that this bus is attempting to get away from another bus following closely behind which is also scheduled to stop at stop (124) and later signals may be altered to clear the route for the first bus, or even to hinder its passage. Similarly, if a different monitored vehicle approaches and slowed to enter, such as a fire truck, but that vehicle is not identified as being a municipal bus, the gate might not be raised or may be raised depending on the expected purpose of the vehicle approaching.

In the depicted embodiment of FIG. 7, the final traffic control zone (112A) is a single rectangular zone covering the left-hand lane, but other arrangements are possible. By way of example and not limitation, this embodiment could use a wide zone (126) which overlaps all lanes, and the monitored vehicle (107) is monitored to determine which lane it is in when it enters each zone. Also by way of example and not limitation, two different sets of zones could be used, one disposed in the left-hand lane (128A) and another in the other lanes (128B).

In another exemplary use, a vehicle's speed through a first zone may be used to make decisions about how the vehicle will be monitored later. For example, if the vehicle is detected as moving at a high velocity in a first traffic control zone, it may be determined to increase the frequency at which the location of the vehicle is determined and updated, because it may otherwise enter and leave a second traffic control zone without detection. Conversely, if a monitored vehicle is detected as moving at a slow velocity in a first traffic control zone, it may be determined to decrease the frequency at which the location of the vehicle is determined and updated, because it is less likely that it will enter and leave another traffic control zone without detection. This can expand battery life in mobile devices and other battery-powered VCUs (101).

Returning to FIG. 5, in another use case, a traffic control zone (130) may be disposed in the controlled intersection (110). When the monitored vehicle (107) passes the final zone (112A) before the intersection (110), the frequency of updates may be increased to a high frequency as the monitored vehicle (107) passes into the intersection zone (130).

Figure 8:
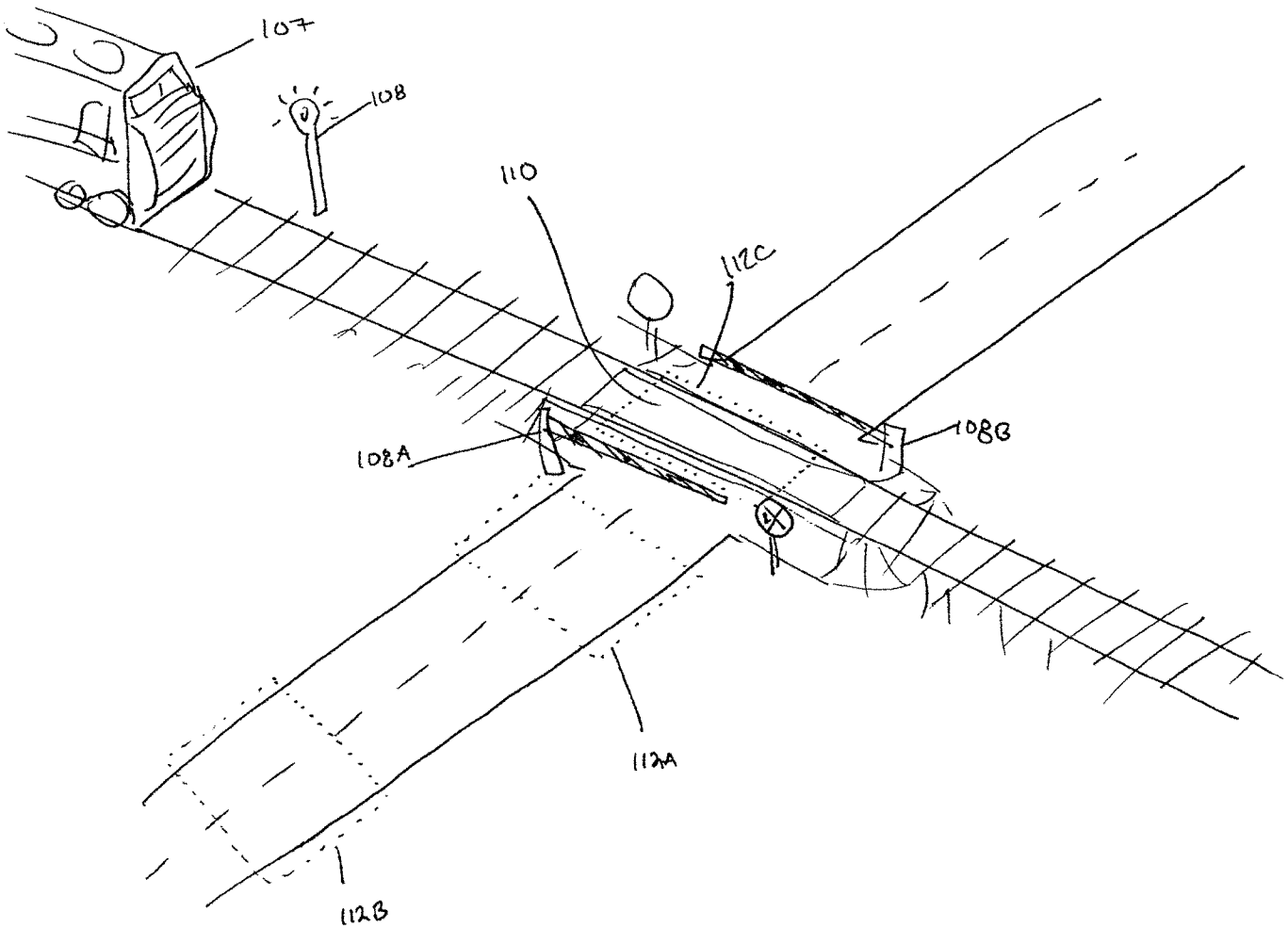
FIG. 8 depicts yet another alternative embodiment of a traffic control system as described herein.

In another exemplary embodiment, the traffic control zone may be disposed at or near a railroad crossing. One such embodiment is depicted in FIG. 8. In the depicted embodiment, a traffic control zone (112C) is disposed at the crossing (110) where the tracks and roadway intersect. Alternatively, zones (112A) and (112B) may be disposed on the approach to (or from) the intersection (110). Typically, a rail vehicle will always have priority and to impose this, physical barriers are often used to prevent passage of traffic across the tracks as the rail vehicle approaches. This reduces stoppage on the tracks by other vehicles that may have encountered congestion on the other side of the tracks and to make sure there is time for a driver to get out of the way should they end up on the tracks as the barriers begin to lower. In effect, rail crossings typically provide a "buffer" of time before the train approaches where traffic is prevented from entering the intersection to make sure that the tracks are clear of any vehicles when the train does arrive.

However, in some cases, providing a large buffer for the approaching train may not be desirable. Again, if a monitored vehicle such as an ambulance is detected in, or approaching, the crossing (110) as described elsewhere herein, instead of lowering the railroad crossing gates and stopping the monitored vehicle (and other traffic), the system may determine that based on the speed of the monitored vehicle (107) an approaching train can sufficiently slow down approaching the crossing (110) to allow the monitored vehicle (107) (and in fact other traffic ahead of it) to safely pass ahead of the train even though all this traffic would normally be halted at the crossing (110). Thus, the detection may result in railroad signal lights and controls being operated to warn approaching rail traffic of a potential obstruction in sufficient time for the rail vehicle to slow or could even automatically adjust the rail vehicle's speed to provide for the monitored vehicle (107) to cross the crossing before the rail vehicle gets there. Further, signals on the other side of the tracks may also be shifted to green to clear any potential congestion which could result in traffic coming through the track crossing within the shortened buffer from having to stop at or near the crossing.

As should be apparent from the above, the systems and methods contemplated herein serve to utilize an interconnected traffic control system to allow for passage of specific vehicles through the roadway system with reduced hindrance. In particular, the systems and methods are generally intended to operate signals both on and around the pathway of a monitored vehicle in such a fashion that obstructions, and particularly other vehicles, are cleared from the pathway of the monitored vehicle through the vehicle's normal interaction with right-of-way signaling. In this way, traffic flow along the pathway can be temporarily altered through the use of existing right-of-way signaling both quickly and without the need for additional infrastructure.

The systems and methods described herein are also appropriate for use in other circumstances. For example, in the instance where ordinary traffic control rules must be suspended in order to facilitate the passage of a sensitive passenger or cargo, the monitored vehicle containing the passenger or cargo may be equipped with a vehicle control unit, and appropriate traffic zones established to block or inhibit traffic from entering the route of such vehicle. For example, these traffic control zones may be established along the main route of the vehicle. This may be appropriate for use, for example, in the case of a presidential or other dignitary motorcade but also for transportation of sensitive cargo, such as an armored car, transportation of a notorious criminal, famous celebrity, transportation of any other individual who bears unusually high risk of threat from the public, or even transportation of dangerous cargos such as overloaded trucks or those carrying dangerous chemicals. It should also be apparent that the level of route clearing could also be selected based on the cargo. Thus, for a high level dignitary or fast moving emergency vehicle, the system may attempt to completely clear the road in front of the vehicle and for some distance behind, while for an armored car or lower risk vehicle, the system may reduce traffic on the pathway, but not worry if it is completely free of other vehicles, effectively allowing the monitored vehicle to travel freely (e.g. without getting stuck in stopped traffic) but still be in normal vehicle flow with other vehicles around it.

A feature of the present disclosure is that in an embodiment, the system may respond to the presence of a monitored vehicle in different zones in a different manner, depending upon the location and purpose of the zone or the vehicle. By way of example and not limitation, for a vehicle detected in a zone proximate a controlled intersection, it is anticipated that the vehicle should be at speed to pass through the intersection and the typical control action may be to maintain the current stop/proceed light signals to minimize the risk of stray cross-traffic and maintain an open path. However, where the same vehicle is detected passing through a zone distal the controlled intersection, the expectation is that the vehicle may be slowing for traffic, and the control action is to begin to alter the control signal state (if needed) to prepare for the vehicle to arrive at the intersection. In an embodiment, the presence of the vehicle in one or more traffic control zones is done by use of the vehicle control unit.

It should be noted that the systems and method described herein may be used to make a traffic control decision not to change a traffic control signal. By way of example and not limitation, if a monitored vehicle is detected in a traffic control zone proximal a controlled intersection traveling at a speed indicative of an intention to enter and cross the intersection, but the signal is red, it may be inferred that the operator of the monitored vehicle has determined through visual inspection that the crossing is clear, and make a decision not to alter the state of the traffic control signals. Still further, while the present disclosure indicates that signals are used which require driver interaction, such signals can also be used to simply direct control of autonomous vehicles with regards to the intersection. Thus, for example, an autonomous vehicle may be instructed not to enter an intersection directly until the vehicle has detected passage of another vehicle.

It should also be noted that the systems and method described herein will typically be used to make a traffic control decision to alter one or more traffic control signals at one or more intersections other than the controlled intersection proximate to a traffic control zone in which a monitored vehicle is detected. It should also be noted that the systems and method described herein may be used to make a traffic control decision to alter one or more traffic control signals based upon a type or classification of the monitored vehicle, and a different decision may be made for two different monitored vehicles operating in proximity having otherwise the same or similar characteristics when detected in the same traffic control zone, based on the difference in vehicle classification. By way of example and not limitation, an ambulance may trigger a different traffic control decision than a law enforcement officer or maintenance vehicle.

Finally, it should also be noted that while the present disclosure has indicated that a monitored vehicle (107) be the one that is detected with its interactions (such as slowing or not slowing), acting as a proxy for the presence of other vehicles, this is by no means required and in a further embodiment, the presence (or absence) of the other vehicles (e.g. the vehicles which would be obstacles to the monitored vehicle (107)) in a zone may be directly detected. In this way, the system could provide direct indications of the clarity of the path from obstructions to the monitored vehicle (107). In this situation, it should be apparent that, for example, an emergency vehicle provided with information that its route is completely clear can proceed at an extremely high rate of speed which is suitable for the path, but would be dangerous if done when other vehicles could be in the path.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A method for permitting a target vehicle to safely violate a right-of-way system of rules, the method comprising:

providing a roadway system, wherein the movements of vehicles within the roadway system are governed by a right-of-way system of rules;

controlling a traffic control system including a plurality of traffic control signals in a manner that causes the plurality of traffic control signals to change in accordance with default control pattern for implementing the right-of-way system of rules;

operating at least one target vehicle including a vehicle control unit within the roadway system, the vehicle having a predetermined route between a starting point and an ending point, said predetermined route passing through at least two signals in said plurality of traffic control signals;

monitoring at least one aspect related to the target vehicle's movement within the roadway system using the vehicle control unit;

modifying the default control pattern based on the at least one aspect monitored by the vehicle control unit to clear the predetermined route between the starting point and the ending point of other vehicles; and permitting the target vehicle to safely violate the right-of-way system of rules by modifying at least a part of the default control pattern along the predetermined route;

wherein the default control pattern includes at least one traffic control signal for a one-way street within the predetermined route, which one-way street has a default direction of traffic, and wherein safely violating the right-of-way system of rules include permitting the target vehicle following the predetermined route to travel against the default direction of traffic on the one-way street; and wherein modifying the default control pattern to clear the predetermined route between the starting point and the ending point of other vehicles includes clearing traffic moving in the default direction on the one-way street prior to arrival of the target vehicle on the one-way street.

2. The method of claim 1, wherein the target vehicle is an ambulance.

3. The method of claim 1, wherein the target vehicle is a bus.

4. The method of claim 1, wherein the at least one aspect monitored by the vehicle control unit is a position of the target vehicle.

5. The method of claim 1, further comprising removing the modification to the default control pattern after the target vehicle reaches a predetermined position.

6. The method of claim 5, wherein the predetermined position is the ending point.

7. The method of claim 5 wherein the predetermined position is a position between the starting point and the ending point.

8. The method of claim 1, further comprising modifying the default control pattern for the at least one traffic control signal to inhibit the other vehicles from entering the one-way street.

9. A method for providing a clear path for a target vehicle operating within a roadway system, the method comprising:

providing a roadway system, wherein the movements of vehicles within the roadway system are governed by a right-of-way system of rules;

providing a target vehicle within the roadway system;

providing a plurality of secondary vehicles within the roadway system;

controlling a traffic control system including a plurality of traffic control signals in a manner that causes the plurality of traffic control signals to change in accordance with default control pattern for implementing a right-of-way system of rules;

operating at least one target vehicle including a vehicle control unit within the roadway system, the vehicle having a predicted path between a starting point and an ending point, said predicted path passing through at least two signals in said plurality of traffic control signals;

monitoring at least one aspect related to the target vehicle's movement within the roadway system using the vehicle control unit;

generating a predicted path for the at least one target vehicle based at least in part upon the at least one aspect monitored by the vehicle control unit; and modifying the default control pattern to clear the predicted path between the starting point and the ending point of the secondary vehicles;

wherein the default control pattern includes at least one traffic control signal for a one-way street within the predicted path, which one-way street has a default direction of traffic, and further comprising permitting the target vehicle following the predicted path to travel against the default direction of traffic on the one-way street; and wherein modifying the default control pattern to clear the predicted path between the starting point and the ending point of the secondary vehicles includes clearing traffic moving in the default direction on the one-way street from the one-way street prior to arrival of the at least one target vehicle on the one-way street.

10. The method of claim 9, wherein the target vehicle is an ambulance.

11. The method of claim 9, wherein the target vehicle is a bus.

12. The method of claim 9, wherein the at least one aspect monitored by the vehicle control unit is a position of the target vehicle.

13. The method of claim 9, further comprising removing the modification to the default control pattern after the target vehicle reaches a predetermined position.

14. The method of claim 13, wherein the predetermined position is the ending point.

15. The method of claim 13, wherein the predetermined position is a position between the starting point and the ending point.

16. The method of claim 9, further comprising modifying the default control pattern for the at least one traffic control signal to inhibit the other vehicles from entering the one-way street.

* * * * *